US007363143B2

(12) United States Patent
Matsushima et al.

(10) Patent No.: US 7,363,143 B2
(45) Date of Patent: Apr. 22, 2008

(54) CONTROL APPARATUS FOR INTERNAL COMBUSTION ENGINE

(75) Inventors: Yuhei Matsushima, Tokyo (JP); Yasuyoshi Hori, Tokyo (JP); Takahiko Oono, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/610,249

(22) Filed: Dec. 13, 2006

(65) Prior Publication Data

US 2007/0245817 A1 Oct. 25, 2007

(30) Foreign Application Priority Data

Apr. 21, 2006 (JP) ..... 2006-117644

(51) Int. Cl.

| | |
|---|---|
| ***F01M 19/00*** | (2006.01) |
| ***F02M 5/00*** | (2006.01) |
| *F02P 51/00* | (2006.01) |
| *F02P 5/00* | (2006.01) |

(52) U.S. Cl. ..... 701/113; 123/406.61; 123/476; 73/118.1

(58) Field of Classification Search ..... 701/101, 701/113, 114; 123/476, 631, 406.61; 73/116, 73/118.1

See application file for complete search history.

(56) References Cited

U.S. PATENT DOCUMENTS

| | | | | |
|---|---|---|---|---|
| 4,941,445 | A * | 7/1990 | Deutsch | 123/406.18 |
| 6,684,687 | B1 * | 2/2004 | Frojdh | 73/117.3 |
| 7,000,598 | B2 * | 2/2006 | Sheikh et al. | 123/476 |

FOREIGN PATENT DOCUMENTS

| | | |
|---|---|---|
| JP | 2005-002847 A | 1/2005 |
| WO | WO 01/38726 A1 | 5/2001 |

* cited by examiner

*Primary Examiner*—Willis R. Wolfe
*Assistant Examiner*—Johnny H. Hoang
(74) *Attorney, Agent, or Firm*—Sughrue Mion, PLLC

(57) ABSTRACT

A control apparatus for an internal combustion engine, comprising crank angle calculation means for calculating a crank angle between edges which are detected by a first crank angle sensor and a second crank angle sensor, on the basis of a crank cycle between the edges, and engine-rotation-direction detection inhibit means for inhibiting detection of an engine rotation direction on the basis of the calculated crank angle, wherein the engine-rotation-direction detection inhibit means inhibits the detection of the engine rotation direction in a case where the crank angle calculated by the crank angle calculation means has satisfied a predetermined inhibit decision condition.

6 Claims, 10 Drawing Sheets

FIG. 4

| | OUTPUT PATTERNS (DETECTION EDGES) | | | |
|---|---|---|---|---|
| | PTN1 (EG11) | PTN2 (EG12) | PTN3 (EG21) | PTN4 (EG22) |
| (a) ENGINE FORWARD MODE | LOW | HIGH | HIGH | LOW |
| (b) ENGINE REVERSE MODE | HIGH | LOW | LOW | HIGH |

FIG. 8A

ENGINE FORWARD MODE

| | OUTPUT PATTERNS | | | |
|---|---|---|---|---|
| | PTN1 | PTN2 | PTN3 | PTN4 |
| FORWARD ROTATION | — | HIGH | — | LOW |

FIG. 8B

ENGINE REVERSE MODE

| | OUTPUT PATTERNS | | | |
|---|---|---|---|---|
| | PTN1 | PTN2 | PTN3 | PTN4 |
| REVERSE ROTATION | HIGH | — | LOW | — |

CONTROL APPARATUS FOR INTERNAL COMBUSTION ENGINE

BACKGROUND OF THE INVENTION

1. Field of the Invention

This invention relates to a control apparatus for an internal combustion engine, including engine-rotation-direction detection means for detecting the rotation direction of the engine on the basis of the outputs of a first crank angle sensor and a second crank angle sensor which are disposed so as to have a predetermined output phase difference therebetween.

2. Description of the Related Art

In recent years, there has been developed the technology of so-called "idle stop" wherein, for the reduction of fuel consumption, the suppression of a $CO_2$ exhaust quantity, etc., an engine is once stopped automatically in an idling mode, and the engine is thereafter restarted automatically when a restarting condition such as car starting manipulation has held.

As a starting device suitable for the restarting of the idle stop, there has been known a technique wherein fuel is fed into the specified cylinder of the engine in a stop state and is ignited and combusted, and the engine is reversed once, thereby to bring the other cylinders substantially into compression states, and the fuel is thereafter fed into the engine and is ignited and combusted, whereby the restartability of the engine is enhanced (refer to, for example, JP-T-2003-515052, where the term "JP-T" means a published Japanese translation of a PCT patent application).

In such a technique, the phases of the pistons of the respective cylinders at stopping and restarting the engine need to be accurately detected. For this purpose, it is indispensable to accurately detect the reverse rotation of the engine attributed to a rotational inertial force immediately before the stop of the engine, and the rotation direction of the engine at the restarting.

As a rotation-direction detection device suitable for the detection of the engine rotation direction, there has been known a technique wherein the rotation direction of the engine is detected while taking note of the fact that the output patterns of two crank angle sensors disposed so as to have a predetermined output phase difference differ between in an engine forward mode and in an engine reverse mode (refer to, for example, JP-A-2005-2847).

In actuality, however, a situation where the output pattern of the crank angle sensors changes in spite of the non-change of the engine rotation direction occurs on account of the mounting errors of the crank angle sensors, the machining error of teeth to-be-detected, the component errors of a crank-angle-sensor output acceptance circuit, a measurement error ascribable to the running state of the engine, sensor characteristics, and so forth. In such a case, with a method wherein the change of the engine rotation direction is decided whenever the output pattern of the crank angle sensors has changed, as in the prior-art rotation-direction detection device disclosed in JP-A-2005-2847, the rotation direction of the engine is erroneously detected to worsen the restartability of the engine, and moreover, the engine might be damaged.

SUMMARY OF THE INVENTION

This invention has been made in order to solve the problems of the prior art as stated above, and has for its object to provide a control apparatus for an internal combustion engine, which includes an engine-rotation-direction detection device that can detect an engine rotation direction at high precision and at a high frequency, and that can prevent the erroneous detection of the engine rotation direction.

Another object of this invention is to provide a control apparatus for an internal combustion engine, in which when an engine rotation direction might be erroneously detected, controls that are performed on the basis of the engine rotation direction are inhibited, thereby to prevent any malcontrol leading to the damage of the engine.

A control apparatus for an internal combustion engine according to this invention consists in a control apparatus for an internal combustion engine, wherein a first crank angle sensor and a second crank angle sensor are disposed for detecting rotation of a crankshaft; the second crank angle sensor is arranged so as to have a predetermined output phase difference relative to the first crank angle sensor; the first and second crank angle sensors output pulse signals which have rising edges and failing edges that are respectively formed upon appearances and disappearances of a plurality of teeth to-be-detected arranged at a circumference of a crank plate; combinations of the rising edge and the falling edge detected by the first crank angle sensor, with output values of the second crank angle sensor are respectively set as a first output pattern and a second output pattern, while combinations of the rising edge and the falling edge detected by the second crank angle sensor, with output values of the first crank angle sensor are respectively set as a third output pattern and a fourth output pattern; and engine-rotation-direction detection means is disposed for deciding that a rotation direction of the engine has changed, when the output patterns have changed; comprising:

crank angle calculation means for calculating a crank angle between the edges which are detected by the first crank angle sensor and the second crank angle sensor, on the basis of a crank cycle between the edges; and engine-rotation-direction detection inhibit means for inhibiting detection of the engine rotation direction on the basis of the crank angle calculated by the crank angle calculation means, wherein the engine-rotation-direction detection inhibit means inhibits the detection of the engine rotation direction based on the output patterns, in a case where the crank angle calculated by the crank angle calculation means has satisfied a predetermined inhibit decision condition.

Besides, the control apparatus further comprising means for inhibiting controls which are performed on the basis of the engine rotation direction, and for reporting the inhibit of the detection of the engine rotation direction to a driver of a vehicle on which the engine is carried, when the detection of the engine rotation direction is inhibited by the engine-rotation-direction detection inhibit means.

According to the control apparatus for an internal combustion engine in this invention, the engine rotation direction can be detected at high precision and a high frequency, and the erroneous detection of the engine rotation direction can be prevented.

Besides, according to the control apparatus for an internal combustion engine in this invention, the controls which are performed on the basis of the engine rotation direction are inhibited in a state where the engine rotation direction is indefinite, whereby any malcontrol leading to the damage of the engine can be prevented.

In addition, the means for reporting the inhibit of the detection of the engine rotation direction to the driver is included, whereby the maintainability of the control apparatus can be enhanced.

BRIEF DESCRIPTION OF THE DRAWINGS

FIG. 4 is a table showing output patterns in FIGS. 3A and 3B;

FIGS. 8A and 8B are tables showing output patterns in FIGS. 7A and 7B, respectively;

DESCRIPTION OF THE PREFERRED EMBODIMENT

Now, an embodiment of this invention will be described with reference to FIGS. 1-10. Incidentally, throughout the drawings, identical numerals and signs shall indicate identical or equivalent portions.

Figure 1:
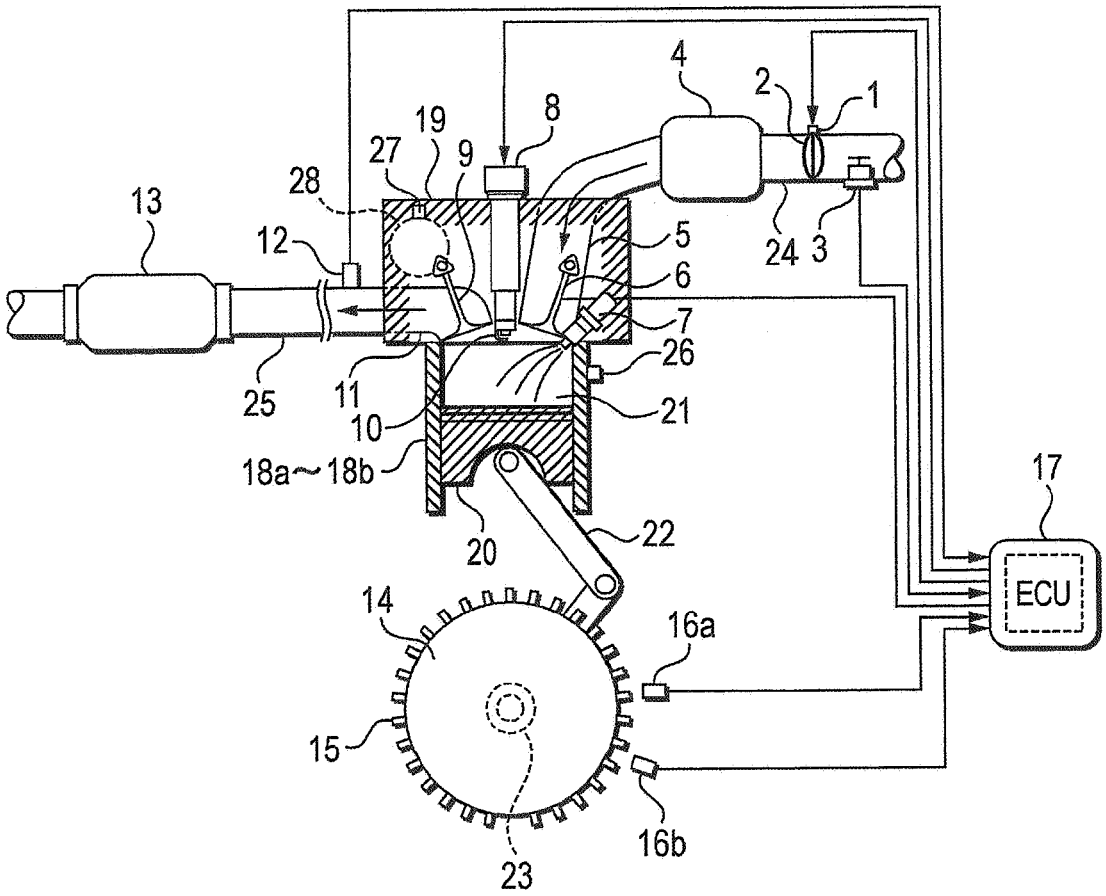
FIG. 1 is a schematic configurational view of a control apparatus for an internal combustion engine in an embodiment of this invention.

FIG. 1 is a schematic configurational view of a control apparatus for an internal combustion engine in the embodiment of this invention.

Referring to FIG. 1, numeral 19 indicates the internal combustion engine, which is a 4-cylinder 4-cycle engine in this embodiment. A piston 20 is snugly inserted in each of four cylinders 18 (18*a*-18*d*), and a combustion chamber 21 is formed over the piston 20. Incidentally, the piston 20 is connected to a crankshaft 23 through a connecting rod 22.

At the upper parts of the combustion chamber 21 of each cylinder 18, there are disposed an ignition plug 10 and a fuel injection valve 7 which injects fuel directly into the combustion chamber 21. The fuel injection valve 7 has a needle valve and a solenoid, not shown, built therein. More specifically, the fuel injection valve 7 is so configured that, when it has a pulse signal inputted thereto, it is driven to open the needle valve, at a pulse input timing and for a time period corresponding to a pulse width, whereby the fuel is injected in a quantity corresponding to the valve opening time period. Besides, the injection direction of the fuel injection valve 7 is set so as to inject the fuel toward the vicinity of the ignition plug 10. Incidentally, the fuel injection valve 7 is fed with the fuel through a fuel feed passage, etc. by a fuel pump not shown, and a fuel feed system is configured so as to be capable of affording a fuel pressure which is higher than a pressure within the combustion chamber 21 in a compression stroke.

An intake port 5 and an exhaust port 11 are open to the combustion chamber 21 of each cylinder 18, and the intake port 5 and the exhaust port 11 are respectively provided with an intake valve 6 and an exhaust valve 9. The intake valve 6 and the exhaust valve 9 are driven by a valve moving mechanism which is configured of a cam shaft, etc. not shown. In addition, the opening and closing timings of the intake and exhaust valves of the individual cylinders are set in order that the respective cylinders 18 may perform combustion cycles with predetermined phase differences.

An intake passage 24 and an exhaust passage 25 are respectively connected to the intake port 5 and the exhaust port 11. The intake passage 24 includes a throttle valve 2 for regulating an intake quantity, in the upstream of a surge tank 4, and the opening degree of the throttle valve 2 is adjusted by a throttle actuator 1.

Disposed in the upstream of the throttle valve 2 is an air flowmeter 3 which detects the air quantity that is imbibed into the engine 19 through the intake port 5 by opening and closing the throttle valve 2.

Besides, in the exhaust passage 25, an oxygen concentration sensor 12 which detects an oxygen concentration in exhaust is disposed, and a ternary catalyst 13 is disposed as a device for purifying noxious gases in the exhaust.

A crank plate 14 is mounted on the crankshaft 23, and a plurality of teeth to-be-detected 15 are provided at the circumference of the crank plate 14. Besides, in order to detect the rotational angle of the crankshaft 23, a crank angle sensor 16*a* (hereinbelow, also termed the "first crank angle sensor") and a crank angle sensor 16*b* (hereinbelow, also termed the "second crank angle sensor") are disposed, and they are mounted so as to output crank angle signals having a predetermined phase difference therebetween.

Further disposed is a cam angle sensor 27 which can give a cam shaft 28 a cylinder identification signal by detecting the specified rotational position of this cam shaft.

Incidentally, there are also disposed a water temperature sensor 26 which detects the temperature of engine cooling water, an accelerator opening degree sensor which detects the opening degree of an accelerator, and so forth. Signals from the individual sensors are inputted to an ECU (engine control unit) 17, and the ECU 17 outputs drive signals to the fuel injection valve 7 and the ignition coil 8 in order to control the engine 19.

Figure 2:
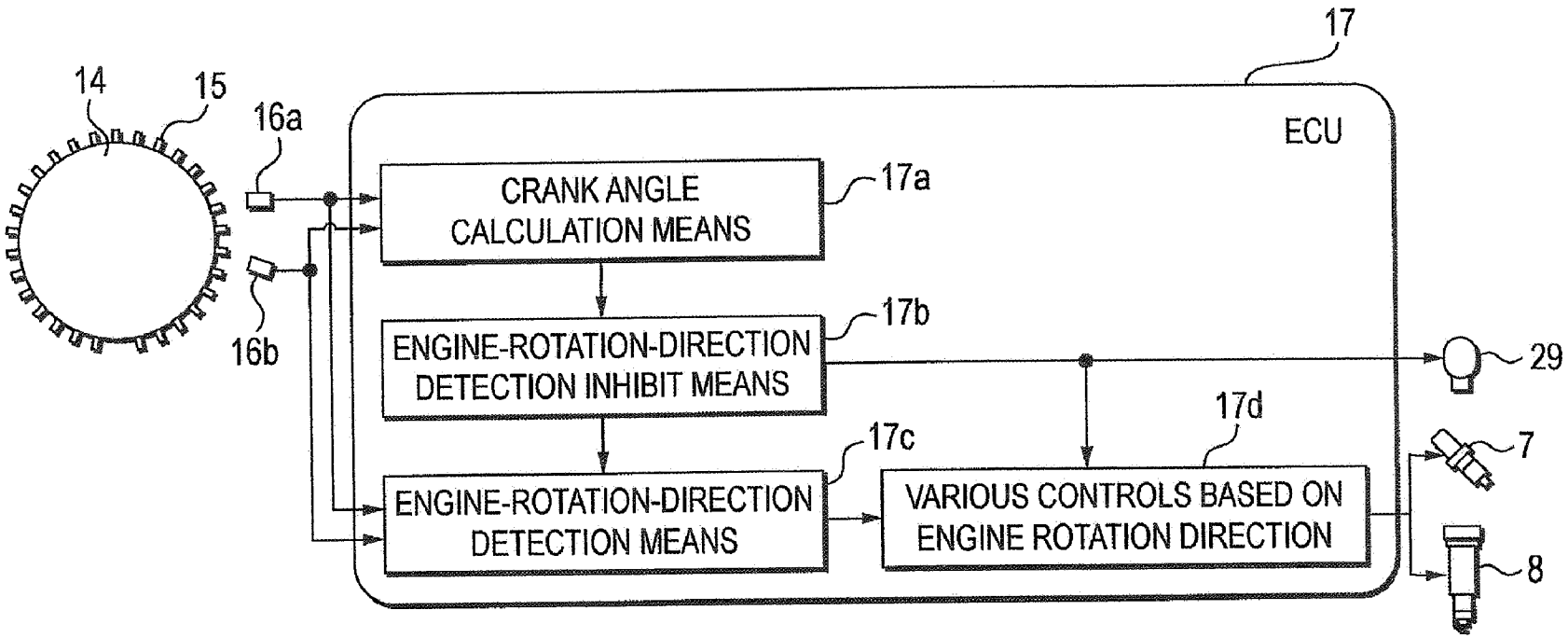
FIG. 2 is a configurational view of an engine-rotation-direction detection device in the embodiment of this invention.

FIG. 2 is a configurational view of an engine-rotation-direction detection device in the embodiment of this invention.

Referring to FIG. 2, the output signals from the crank angle sensor 16*a* and the crank angle sensor 16*b* are accepted into the ECU 17. The ECU 17 includes crank angle calculation means 17*a*, engine-rotation-direction detection inhibit means 17*b*, engine-rotation-direction detection means 17*c*, and means 17*d* for performing various controls based on an engine rotation direction.

As will be explained later, in the engine-rotation-direction detection means 17*c*, an output pattern is monitored on the basis of the output signal waveforms of the crank angle sensors 16*a* and 16*b*. When the output pattern has changed, it is detected that the rotation direction of the engine has changed.

In the crank angle calculation means 17*a*, the crank angle between the edges of the output signal waveforms of the crank angle sensors 16*a* and 16*b* is calculated on the basis of the cycles between the edges.

In the engine-rotation-direction detection inhibit means 17*b*, the executions of the various controls based on the engine rotation direction and by the control means 17*d* are inhibited in a case where the crank angle calculated by the crank angle calculation means 17*a* corresponds to a predetermined inhibit condition. This situation is reported to the driver of a vehicle by display means 29. The display means 29 is, for example, a warning lamp which is lit up on a dash panel, or a tester on which the inhibit condition is indicated.

The respective means will be concretely described below.

Figure 3A:
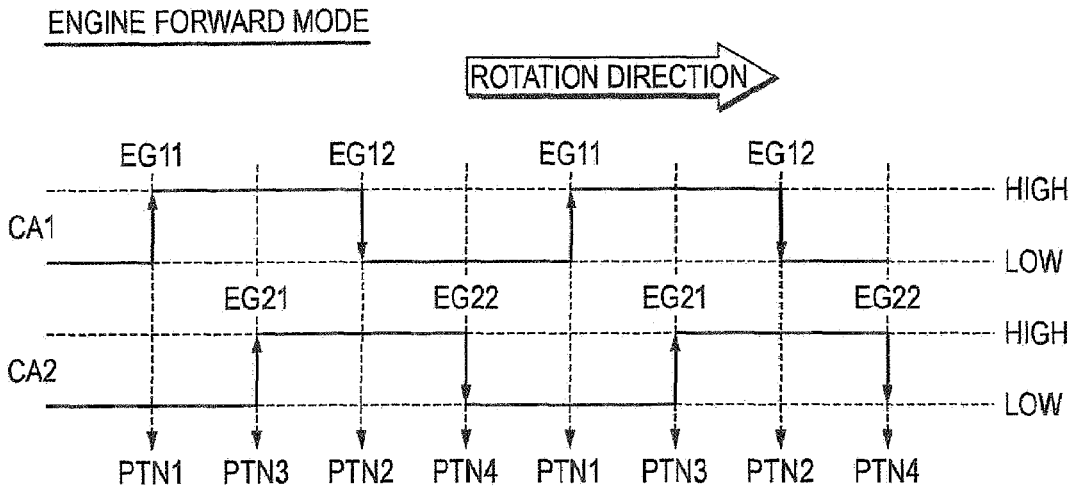
FIGS. 3A and 3B are diagrams for explaining engine-rotation-direction detection means in the embodiment of this invention.
Figure 3B:
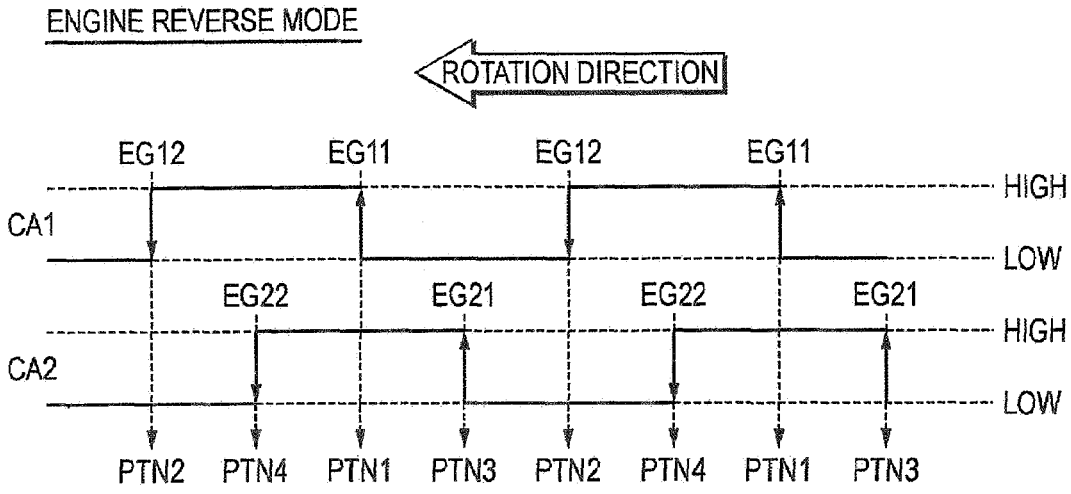

FIGS. 3A and 3B show a practicable example of the engine-rotation-direction detection means 17*c* in FIG. 2. They show a first crank angle signal CA1 which is outputted from the crank angle sensor 16*a* by the rotation of the crankshaft 23, and a second crank angle signal CA2 which is outputted from the crank angle sensor 16*b*.

The output pattern is the combination of the detections of the appearance (rising edge: EG11 or EG21) and disappearance (falling edge: EG12 or EG22) of the tooth to-be-detected 15 by either the crank angle sensor 16*a* or the crank angle sensor 16*b*, with the output level (HIGH or LOW) of the other crank angle sensor. The output patterns at the times when the first crank angle signal CA1 has detected the rising edge EG11 and the falling edge EG12, are respectively set as a first pattern PTN1 and a second pattern PTN2. Likewise, the output patterns at the times when the second crank angle signal CA2 has detected the rising edge EG21 and the falling edge EG22, are respectively set as a third pattern PTN3 and a fourth pattern PTN4.

In an engine forward mode, as shown in FIG. 3A, the first crank angle signal CA1 is generated with a phase lead of about a half pulse width relative to the second crank angle signal CA2, whereby when the first crank angle signal CA1 has detected the rising edge EG11, the output level of the second crank angle signal CA2 becomes LOW (the first pattern PTN1), and when the first crank angle signal CA1 has detected the falling edge EG12, the output level of the second crank angle signal CA2 becomes HIGH (the second pattern PTN2).

Likewise, when the second crank angle signal CA2 has detected the rising edge EG21, the output level of the first crank angle signal CA1 becomes HIGH (the third pattern PTN3), and when the second crank angle signal CA2 has detected the falling edge EG22, the output level of the first crank angle signal CA1 becomes LOW (the fourth pattern PTN4).

In an engine reverse mode, as shown in FIG. 3B, the first crank angle signal CA1 is generated with a phase lag of about the half pulse width relative to the second crank angle signal CA2, whereby when the first crank angle signal CA1 has detected the rising edge EG11, the output level of the second crank angle signal CA2 becomes HIGH (≠the first pattern PTN1), and when the first crank angle signal CA1 has detected the falling edge EG12, the output level of the second crank angle signal CA2 becomes LOW (≠the second pattern PTN2).

Besides, when the second crank angle signal CA2 has detected the rising edge EG21, the output level of the first crank angle signal CA1 becomes LOW (≠the third pattern PTN3), and when the second crank angle signal CA2 has detected the falling edge EG22, the output level of the first crank angle signal CA1 becomes HIGH (≠the fourth pattern PTN4).

FIG. 4 is a table in which the output patterns in FIGS. 3A and 3B are put in order.

The ECU 17 detects the rotation directions of the engine by detecting the changes of the output patterns in the engine forward mode and the engine reverse mode.

Figure 5:
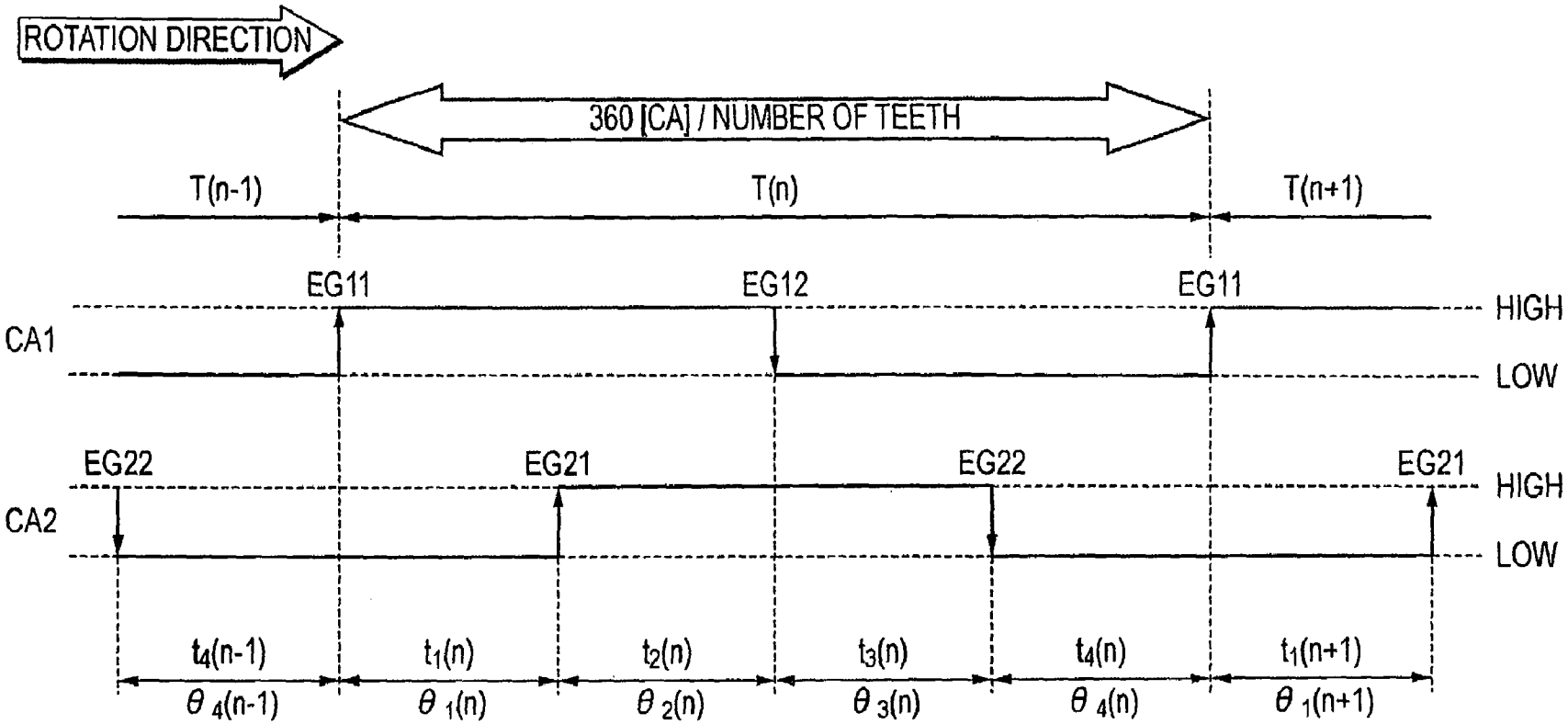
FIG. 5 is a diagram for explaining crank angle calculation means in the embodiment of this invention.

FIG. 5 shows a practicable example of the crank angle calculation means 17*a* in FIG. 2. It shows the first crank angle signal CA1 and the second crank angle signal CA2 which are obtained by the rotation of the crankshaft 23.

The crank angle $\theta_z(n)$ between the edges which are detected by the first crank angle signal CA1 and the second crank angle signal CA2 is represented by:

$$\theta_z(n)=360/(\text{Number of Teeth to-be-detected})/M\times t_z(n)/T(n)[CA](\because z: 1, 2, 3, 4) \quad (1)$$

Here, T(n) [msec] denotes the cycles between predetermined edges (for M cycles) in the first crank angle signal CA1, and $t_z(n)$ [msec] denotes the cycle between edges which are successively measured by the first crank angle signal CA1 and the second crank angle signal CA2.

In FIG. 5, T(n) measures one cycle of the first crank angle signal CA1, and hence, M=1 holds.

The crank angle sensor 16*a* and the crank angle sensor 16*b* are mounted so that the first crank angle signal CA1 may be generated with the phase lead of about the half pulse width (¼ cycle) relative to the second crank angle signal CA2. Therefore, the crank angle $\theta_z(n)$ which is calculated by the above formula (1), usually becomes a reference crank angle $\theta_{base}$ [CA] which is calculated by the following formula (2):

$$\theta_{base}=360/(\text{Number of Teeth to-be-detected})/4\ [CA] \quad (2)$$

In actuality, however, the crank angle $\theta_z(n)$=the reference crank angle $\theta_{base}$ is difficult to hold, on account of the mounting errors of the crank angle sensors, the machining error of the teeth to-be-detected, the component errors of a crank-angle-sensor output acceptance circuit, a measurement error ascribable to the running state of the engine, the characteristics of the sensors, and so forth.

The mounting errors of the crank angle sensors, the machining error of the teeth to-be-detected, etc. are uniquely determined for the engine as an offset error $\theta_{offset}$ [CA].

The component errors of the crank-angle-sensor output acceptance circuit, the measurement error, errors ascribable to the sensor characteristics, etc., sequentially change during the measurement within a predetermined error range $\theta_{error}$ [CA].

Figure 6:
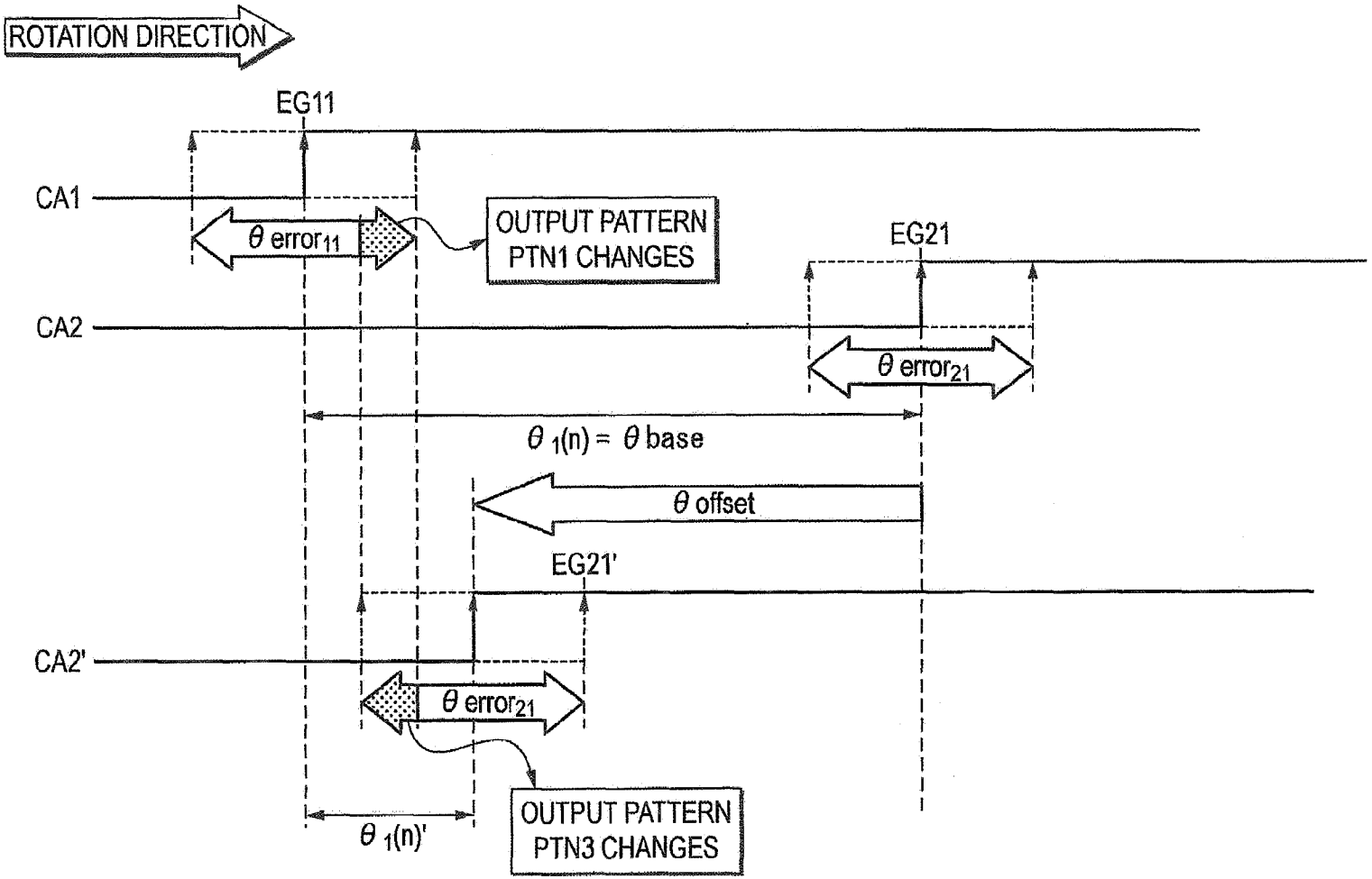
FIG. 6 is a diagram for explaining engine-rotation-direction detection inhibit means in the embodiment of this invention.

FIG. 6 shows a practicable example of the engine-rotation-direction detection inhibit means 17*b* in FIG. 2. It shows a state (the crank angle signal CA2) where a crank angle $\theta_1(n)$=the reference crank angle $\theta_{base}$ holds, and a state (a crank angle signal CA2') where the crank angle $\theta_1(n)$<the reference crank angle $\theta_{base}$ holds due to the offset error $\theta_{offset}$.

In the state of the crank angle signal CA2, even when the detection positions of the rising edges EG11 and EG21 have deviated due to respective error ranges $\theta_{error11}$ and $\theta_{error21}$ in the case of detecting these rising edges EG11 and EG21, the output patterns PTN1 and PTN3 do not change.

In the state of the crank angle signal CA2', in a case where the detection positions of the rising edges EG11 and EG21 have deviated due to the respective error ranges $\theta_{error11}$ and $\theta_{error21}$ in the case of detecting these rising edges EG11 and EG21, the output patterns PTN1 and PTN3 change.

In the engine-rotation-direction detection device, the change of the rotation direction of the engine is detected by detecting the changes of the output patterns, and hence, the engine rotation direction is erroneously detected in a state like that of the crank angle signal CA2'. Therefore, the detection of the engine rotation direction shall be inhibited in a case where the following formula (3) of an inhibit decision condition has held:

$$\theta_1(n) \leqq \theta_{error11} + \theta_{error21} \quad (3)$$

The formula (3) of the inhibit decision condition signifies to inhibit the detection of the engine rotation direction in a case where the crank angle $\theta_z(n)$ becomes equal to or less than the sum of the error ranges which can be assumed in detecting the edges of both the ends of this crank angle $\theta_z(n)$.

Besides, the error range $\theta_{error}$ has a value differing every edge, and it is previously determined by a desktop calculation or experiment based on circuit specifications.

Since the error range $\theta_{error}$ [CA] depends also upon the engine rotation, a battery voltage, etc., it may well be evaluated as a map in which the values of the parameters are taken on axes.

Figure 7A:
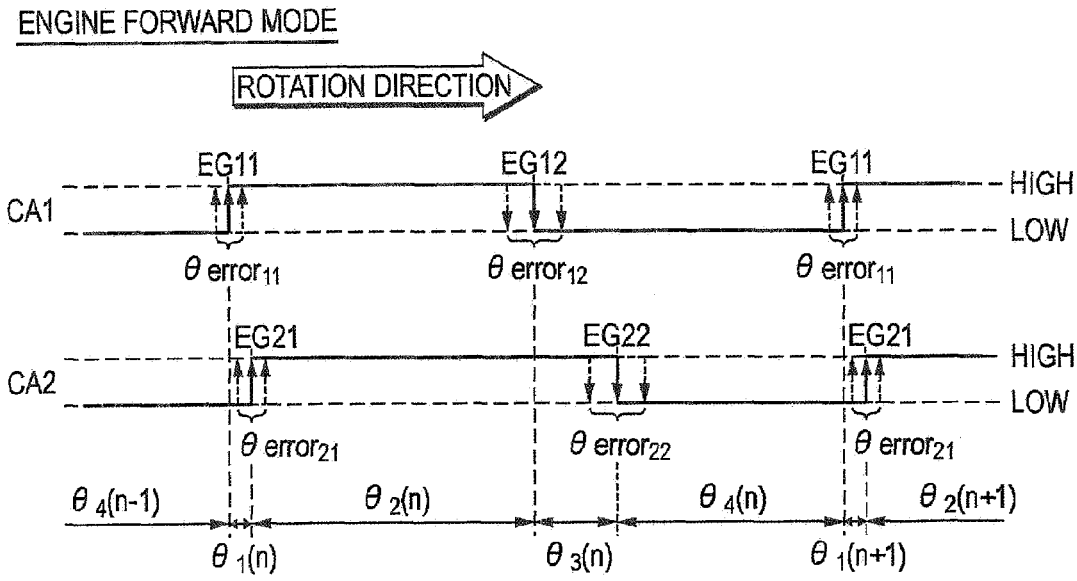
FIGS. 7A and 7B are diagrams for explaining the engine-rotation-direction detection inhibit means in the embodiment of this invention.
Figure 7B:
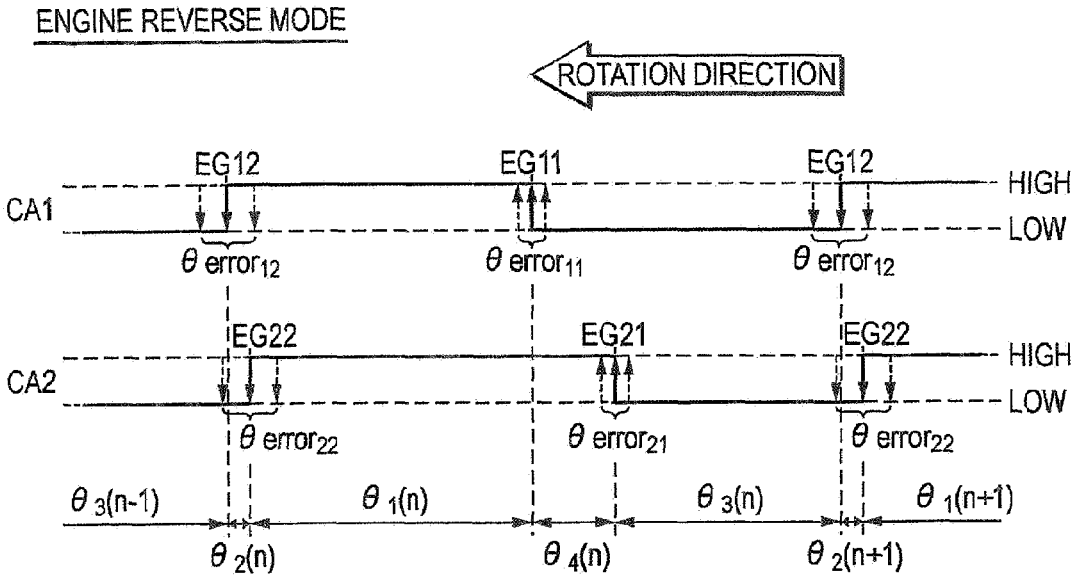

FIGS. 7A and 7B show the error ranges $\theta_{error}$ which can be assumed in detecting the respective edges, and the crank angles $\theta_z(n)$ between the edges, regarding the crank angle signal CA1 and the crank angle signal CA2 that are obtained by the rotation of the crankshaft.

FIGS. 8A and 8B are tables in which output patterns in FIGS. 7A and 7B are respectively put in order.

In the engine forward state of FIG. 7A, only the crank angle $\theta_1(n)$ agrees with the inhibit decision condition of the engine-rotation-direction detection, and the output patterns PTN2 and PTN4 are normally detected as shown in FIG. 8A.

Besides, in the engine reverse state of FIG. 7B, only the crank angle $\theta_2(n)$ agrees with the inhibit decision condition of the engine-rotation-direction detection, and the output patterns PTN1 and PTN3 are normally detected as shown in FIG. 8B.

In the cases as shown in FIGS. 7A and 7B, the output pattern in the forward mode and the corresponding output pattern in the reverse mode are different, and hence, the engine rotation direction can be detected by detecting the difference.

In this manner, in the engine-rotation-direction detection device of this embodiment, the engine rotation direction can be normally detected in the case where the output pattern can be normally detected in spite of the agreement of the rotational crank angle $\theta_z(n)$ with the inhibit condition, so that the detection frequency of the engine rotation direction can be enhanced.

Figure 10:
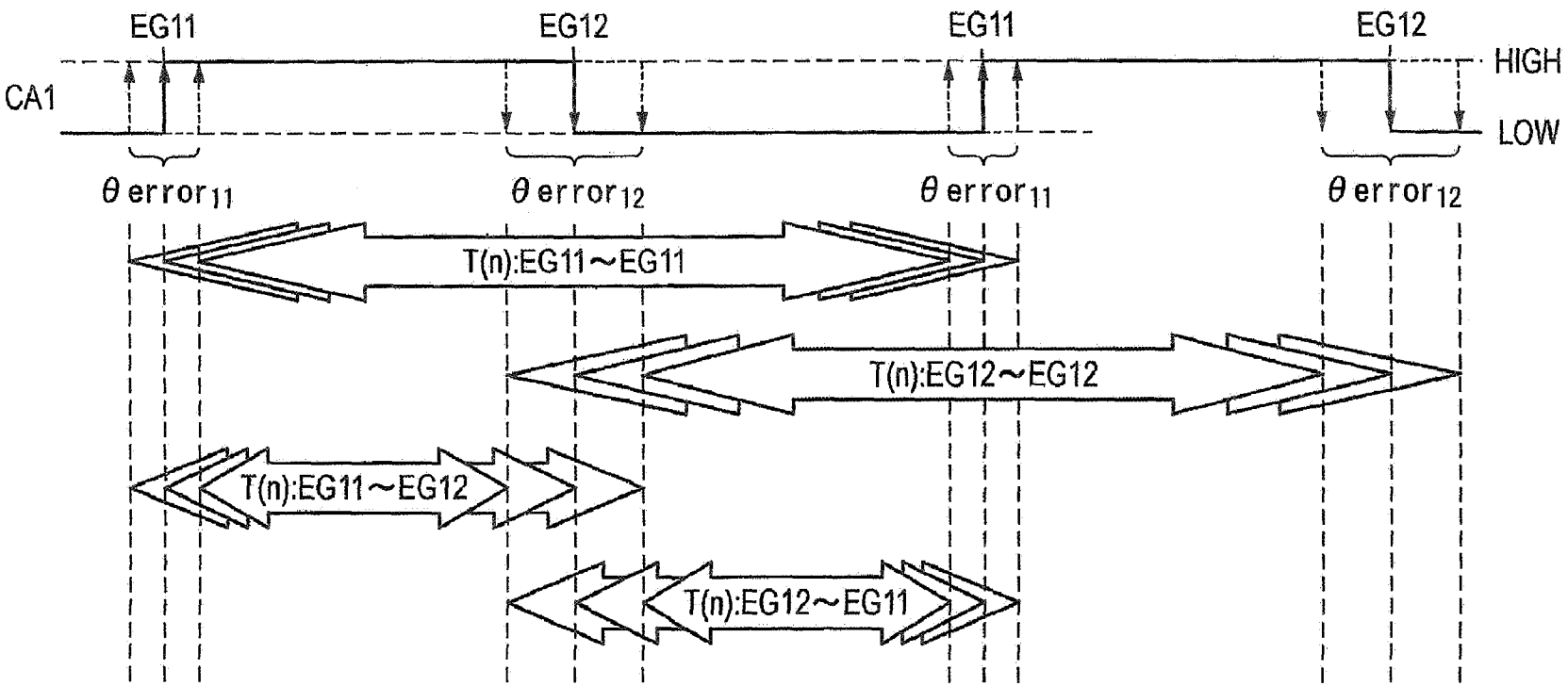
FIG. 10 is a diagram showing the variances of measurement cycles dependent upon the edges of a crank angle signal.

FIG. 10 shows the variances of the cycles T(n) [msec] between predetermined edges in the first crank angle signal CA1. It is assumed to be previously known that the error ranges become the relationship of $\theta_{error11} < \theta_{error12}$ at the rising edge EG11 and the falling edge EG12, on account of the component errors of the crank-angle-sensor output acceptance circuit, the measurement error ascribable to the running state of the engine, the sensor characteristics, etc. In this case, when the cycle T(n) is measured with the falling edge EG12 as a trigger, the measurement error enlarges, and the calculation error of the crank angle $\theta_z(n)$ which is calculated using the cycle T(n) increases, so that the accurate crank angle $\theta_z(n)$ cannot be obtained.

Accordingly, the edge of the smaller error range is used for the measurement of the cycle T (n), whereby the crank angle $\theta_z(n)$ can be accurately calculated, and the detection precision of the engine rotation direction can be enhanced.

Likewise, in a case where the running state of the engine is unstable on the occasion of, for example, an acceleration or deceleration involving an abrupt engine rotation fluctuation, or the occurrence of misfire ascribable to the inferior combustion of the engine, the correlation of the cycles T(n) and $t_z(n)$ fails to hold, and the error of the crank angle $\theta_z(n)$ increases.

In order to avoid such a situation, the series of crank angle calculations are executed in a state where the engine is stably rotating in one direction in, for example, an idling mode or a steady-state traveling mode under the constant rotation of the engine, whereby the crank angle $\theta_z(n)$ between the edges can be accurately calculated.

Next, the operation of the engine-rotation-direction detection device in this embodiment will be described in conjunction with the flow chart of FIG. 9.

Figure 9:
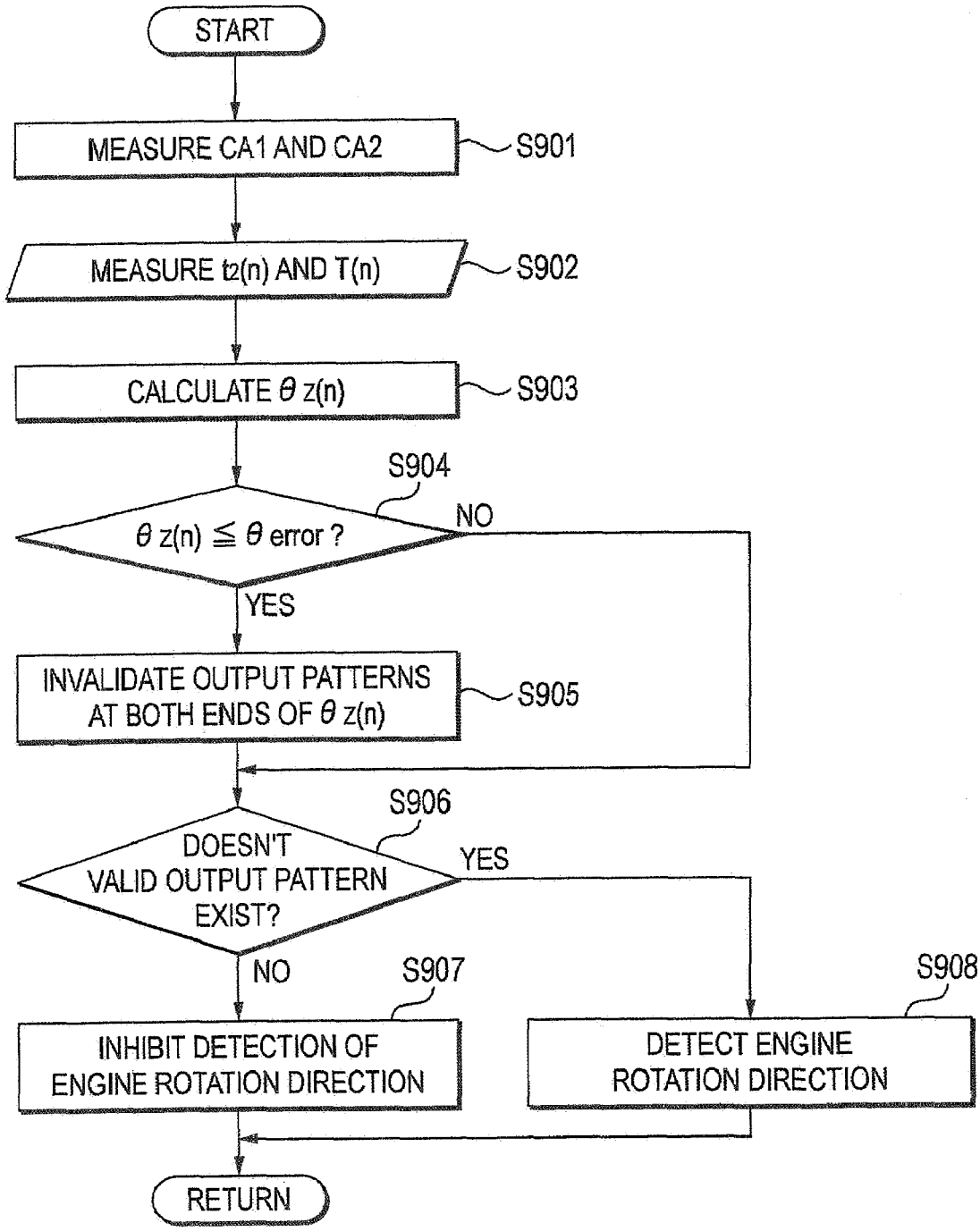
FIG. 9 is a flow chart representing the operation of the embodiment of this invention.

Referring to FIG. 9, when the start switch of the engine, not shown, is turned ON, a crank angle signal CA1 and a crank angle signal CA2 are measured at a step S901.

Subsequently, at a step S902, the cycle $t_z(n)$ between edges which are successively detected by the crank angle signals CA1 and CA2, and the cycle T (n) between predetermined edges which are detected by the crank angle signal CA1 are measured at a step S902.

At a step S903, the crank angle $\theta_z(n)$ between the edges which are successively detected by the crank angle signals CA1 and CA2 is calculated on the basis of the measured cycles $t_z(n)$ and T(n).

At a step S904, whether or not the calculated crank angle $\theta_z(n)$ is equal to or less than the error range $\theta_{error}$ is judged. In a case where the crank angle is equal to or less than the error range, output patterns at both the ends of the crank angle $\theta_z(n)$ are invalidated at a step S905, and in the other case, the routine proceeds to a step S906.

At the step S906, whether or not any output pattern which is valid for the detection of an engine rotation direction exists is judged. In a case where the valid output pattern does not exist, the detection of the rotation direction of the engine is inhibited at a step S907, so as to inhibit controls which are performed on the basis of the rotation direction of the engine, and to report the abnormality to the driver of a vehicle, whereupon the processing is repeated. On the other hand, in a case where any valid output pattern exists, the detection of the rotation direction of the engine is performed at a step S908, whereupon the processing is repeated.

As described above, according to the control apparatus for the internal combustion engine in the embodiment of this invention, a control apparatus for an internal combustion engine, including engine-rotation-direction detection means for detecting a rotation direction of the engine on the basis of output waveforms of two crank angle sensors as have a predetermined phase difference therebetween, comprises crank angle calculation means for calculating a crank angle between edges which are detected by the first crank angle sensor and the second crank angle sensor, on the basis of a crank cycle between the edges, and engine-rotation-direction detection inhibit means for inhibiting detection of an engine rotation direction on the basis of the crank angle calculated by the crank angle calculation means, wherein the engine-rotation-direction detection inhibit means is configured so as to inhibit the detection of the engine rotation direction based on an output pattern, in a case where the crank angle calculated by the crank angle calculation means has satisfied a predetermined inhibit decision condition. Therefore, the control apparatus can attain excellent operations and advantages as stated below.

Even at the occurrence of a situation where the output pattern of the crank angle sensors changes in spite of the non-change of the engine rotation direction, on account of the mounting errors of the crank angle sensors, the machining error of teeth to-be-detected, the component errors of a crank-angle-sensor output acceptance circuit, a measurement error ascribable to the running state of the engine, sensor characteristics, and so forth, the detection of the engine rotation direction is inhibited, whereby the engine rotation direction is not erroneously detected, and controls which are performed on the basis of the engine rotation direction can be effectively executed.

Besides, only the output pattern in the case where the edges relevant to the calculation of the crank angle forming the inhibit decision condition have been detected is inhibited from being used for the detection of the engine rotation direction, so that the rotation direction of the engine can be precisely detected, and moreover, the detection frequency of the engine rotation direction can be enhanced without unnecessarily inhibiting the detection of the rotation direction.

Besides, the crank cycle between the edges of high detection precision is used for the crank angle calculation, whereby the rotation direction of the engine can be precisely detected.

Besides, since the appropriate inhibit decision condition can be set every crank angle to-be-calculated, the rotation direction of the engine can be precisely detected, and moreover, the detection frequency of the engine rotation direction can be enhanced without unnecessarily inhibiting the detection of the rotation direction.

Besides, the crank angle is calculated in a state where the engine is stably rotating in one direction, whereby the accurate crank angle between the edges can be calculated without being influenced by the measurement error of the crank cycle attributed to a rotational fluctuation, and the engine-rotation-direction detection inhibit means based on the crank angle can be accurately operated.

Further, in a state where the rotation direction of the engine is indefinite, controls which are performed on the basis of the engine rotation direction are inhibited, and hence, any malcontrol leading to the damage of the engine can be prevented. Besides, the control apparatus is provided with means for reporting to the driver of a vehicle the fact that the detection of the engine rotation direction is inhibited, whereby the maintainability of the control apparatus can be enhanced, and hence, the other controls which are performed on the basis of the detection of the engine rotation direction can be effectively executed.

What is claimed is:

1. A control apparatus for an internal combustion engine, wherein a first crank angle sensor and a second crank angle sensor are disposed for detecting rotation of a crankshaft; the second crank angle sensor is arranged so as to have a predetermined output phase difference relative to the first crank angle sensor; the first and second crank angle sensors output pulse signals which have rising edges and falling edges that are respectively formed upon appearances and disappearances of a plurality of teeth to-be-detected arranged at a circumference of a crank plate; combinations of the rising edge and the falling edge detected by the first crank angle sensor, with output values of the second crank angle sensor are respectively set as a first output pattern and a second output pattern, while combinations of the rising edge and the falling edge detected by the second crank angle sensor, with output values of the first crank angle sensor are respectively set as a third output pattern and a fourth output pattern; and engine-rotation-direction detection means is disposed for deciding that a rotation direction of the engine has changed, when the output patterns have changed; comprising:

crank angle calculation means for calculating a crank angle between the edges which are detected by the first crank angle sensor and the second crank angle sensor, on the basis of a crank cycle between the edges; and engine-rotation-direction detection inhibit means for inhibiting detection of the engine rotation direction on the basis of the crank angle calculated by said crank angle calculation means, wherein said engine-rotation-direction detection inhibit means inhibits the detection of the engine rotation direction based on the output patterns, in a case where the crank angle calculated by said crank angle calculation means has satisfied a predetermined inhibit decision condition.

2. A control apparatus for an internal combustion engine as defined in claim 1, wherein said engine-rotation-direction detection inhibit means does not use the output pattern based on the edges forming the crank angle, for the detection of the engine rotation direction, in the case where the crank angle calculated by said crank angle calculation means has satisfied the predetermined inhibit decision condition.

3. A control apparatus for an internal combustion engine as defined in claim 1, wherein said crank angle calculation means calculates the crank angle by using the cycle between the edges as has a smaller detection error measured by either of the crank angle sensors.

4. A control apparatus for an internal combustion engine as defined in claim 1, wherein the inhibit decision condition is set on the basis of error ranges which can be assumed when the edges are detected by the first crank angle sensor and the second crank angle sensor.

5. A control apparatus for an internal combustion engine as defined in claim 1, wherein said crank angle calculation means executes the calculation of the crank angle when it has been decided that the engine is stably rotating in one direction.

6. A control apparatus for an internal combustion engine as defined in claim 1, further comprising means for inhibiting controls which are performed on the basis of the engine rotation direction, and for reporting the inhibit of the detection of the engine rotation direction to a driver of a vehicle on which the engine is carried, when the detection of the engine rotation direction is inhibited by said engine-rotation-direction detection inhibit means.

* * * * *